United States Patent [19]

Wells

[11] 4,009,660

[45] Mar. 1, 1977

[54] INKING IN LITHO PRINTING THROUGH A NON-IMAGED SCREEN

[75] Inventor: John B. Wells, Savannah, N.Y.

[73] Assignee: Xerox Corporation, Stamford, Conn.

[22] Filed: Nov. 10, 1975

[21] Appl. No.: 630,838

Related U.S. Application Data

[63] Continuation of Ser. No. 456,349, March 29, 1974, abandoned.

[52] U.S. Cl. ..... 101/450; 101/128.2; 101/170; 101/455; 101/463; 101/335

[51] Int. Cl.[2] ..... B41M 1/08; B41F 31/22

[58] Field of Search ..... 101/128.2–128.4, 101/455, 463, 466, 467, 470, 471, 395, 401.1, 426, 450; 156/4, 5; 117/6, 35.5, 38, 62.1, 161 ZA, 132 BS; 96/35, 36, 36.2–36.4

[56] References Cited

UNITED STATES PATENTS

| | | | |
|---|---|---|---|
| 2,132,086 | 10/1938 | Scheffler | 101/175 |
| 2,310,788 | 2/1943 | Hummelchen | 101/350 |
| 2,698,574 | 1/1955 | Dougherty | 101/120 |
| 2,887,367 | 5/1959 | Eisner | 101/128.2 X |
| 3,002,866 | 10/1961 | Gartrell et al. | 29/132 X |
| 3,139,826 | 7/1964 | Rainwater | 101/348 |
| 3,223,838 | 12/1965 | Hoshino et al. | 101/471 X |
| 3,296,161 | 1/1967 | Kulpa | 260/18 |
| 3,613,578 | 10/1971 | Heurich | 29/121 R |
| 3,645,204 | 2/1972 | Gosnell | 101/369 |
| 3,672,934 | 6/1972 | Larry | 427/210 |
| 3,745,059 | 7/1973 | Kubo et al. | 101/128.2 X |
| 3,772,016 | 11/1973 | Anderson et al. | 101/459 |
| 3,775,115 | 11/1973 | Sorkin et al. | 101/466 |

*Primary Examiner*—Clyde I. Coughenour
*Attorney, Agent, or Firm*—James J. Ralabate; James Paul O'Sullivan; Donald M. MacKay

[57] ABSTRACT

A method of selectively reinking an imaged master having residual ink on its image areas after transfer of an image to a receiving member, comprising interposing a screen between and in contact with said master and an inking member containing a viscous lithographic ink, the web of said screen coated with an ink releasing adhesive material having an adhesive release value when dry of less than about 100 grams per inch, and passing ink through the pores of said screen to only the imaged portions of said master.

9 Claims, 4 Drawing Figures

INKING IN LITHO PRINTING THROUGH A NON-IMAGED SCREEN

This is a continuation, of application Ser. No. 456,349, filed Mar. 29, 1974 now abandoned.

BACKGROUND OF THE INVENTION

In conventional water-based lithography, an aqueous fountain solution if first applied to a planographic plate having a pattern of water repellent areas on a water receptive background whereby the water wets only the hydrophilic areas. Generally the inked image is then transferred to an offset (blanket) roller from which the actual printing takes place. Alternatively the inked image can be transferred directly to the receiver sheet.

Although lithographic printing has been widely recognized and commercialized to a great extent, there have been problems in ink-fountain solution emulsification, and maintaining the required delicate balance between the quantity of ink and fountain solution employed in order to maintain image fidelity and uniformity. An imbalance of the proper ink to water ratio can cause background inking (scumming) if there is insufficient water or insufficient image density (blinding) if excessive water covers the image areas of the plate. It is to these problems to which this invention is directed.

BRIEF DESCRIPTION OF THE DRAWINGS

Referring now to the drawings,

FIG. 2 depicts the screen on an imaged master, whereas

BRIEF DESCRIPTION OF THE INVENTION

It has now been discovered that a printing plate can be selectively inked by interposing an adhesive ink releasing screen between an inked imaged master and an inking member while passing ink through said screen to only the image portions of said master so that it is not required that fountain solution be applied to the master. More particularly, it has been discovered that a conventional screen, having its network coated with an ink releasing adhesive material can be placed over an imaged master, having residual ink on its image areas after transfer of an image to a receiving member, and an inking member such as a resilient roller pressed against said screen and master so that the ink is selectively passed through this screen to reink the image areas but not contaminate the nonimage areas. Thus it is only necessary to apply fountain solution to the master in order to initially ink the master. Thereafter ink will only be pulled through the screen in the image areas even after the fountain solution is depleted on the non-image areas. Because the network of the screen is coated with an adhesive material, which is ink releasing, the ink will not spread along the screen from the image areas and neither the ink nor the fountain solution will adhere to the screen network. By employing a master with a slightly raised image, the image areas will protrude slightly into the pores of the screen so as to be selectively inked when the inking member is pressed thereon without inking the nonimaged areas. When sufficient ink remains on the imaged master, however, the cohesive attraction of the ink on the image for ink from the resilient inking member will permit the use of masters with little relief, no relief or even a slight image depression. Further, because the fountain solution does not penetrate through the screen, this process avoids mixing of the ink and fountain solution and obviates the requirement of critically controlling the amount of fountain solution fed to the printing master. Other benefits will be apparent from the following detailed description of the invention.

DETAILED DESCRIPTION OF THE INVENTION

Figure 1:
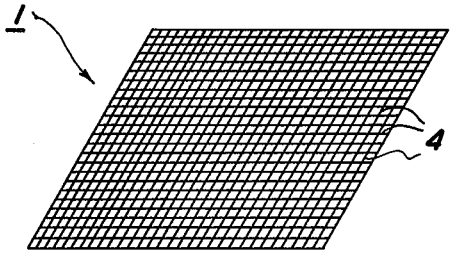
FIG. 1 has a screen 1 in which the web 4 is coated with an ink releasing silicone elastomer.
Figure 2:
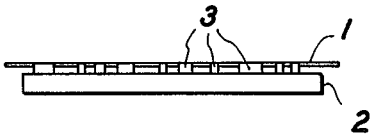
Figure 3:
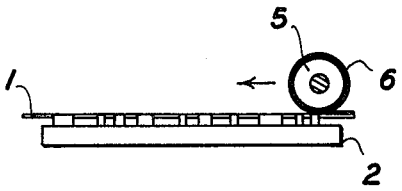
FIG. 3 depicts an inking roller in contact with the screen and master.
Figure 4:
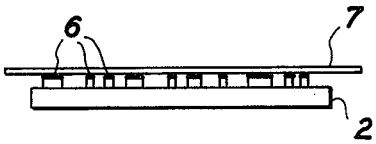
FIG. 4 depicts a master in which the screen has been removed and a receiver sheet placed thereon to transfer the inked image.

FIG. 1 of the drawing depicts a screen 1 in which the web 4 is coated with an ink releasing silicone elastomer. In FIG. 2, the screen is shown in contact with a master 2 wherein the image 3 is shown passing through the pores of the screen. In FIG. 3 an inking roller 5 containing ink 6 thereon is shown in contact with the screen and master whereby the image areas are selectively inked. In FIG. 4 the master is shown with the screen removed in contact with a receiver sheet 7 whereby the inked image is transferred to the receiver sheet.

Screens suitable for use in the invention can be readily obtained commercially and include mesh, fabric or cloth formed of any weavable material such as silk, nylon, Dacron and the like fibers as well as metal wires such, for example, as stainless steel. The screen will generally have a pore size of between about 5 and about 1000 microns, and preferably between about 10 and about 15 microns. The thickness of the screen will generally be between about 12 and about 100 microns. The particular screen employed, however, will depend upon the image requirements as well as other variables such as the type of ink, coating on the screen and fountain solution employed as is readily apparent to one having ordinary skill in the art.

The ink releasing or adhesive material employed to coat the screen can be any material which has an adhesive release value when dry of less than about 100 grams per inch. The release value for a given material can be determined by applying a piece of adhesive tape, such as surgical tape, to the surface of the material and thereafter measuring the amount of force required to strip the adhesive tape from the surface. Standard tests for determining release values are diclosed in Curtin, U.S. Pat. No. 3,511,178 (column 8) which is herein incorporated by reference.

Generally the ink releasing materials employed to coat the screen are essentially linear, solid, cured, rubbery, organopolysiloxanes, commonly referred to as silicone elastomers.

Ink releasable silicones which can be employed in the invention to coat the screen include silicone polymer gums and heterophase polymeric compositions having a silicone phase such as organopolysiloxane copolymers including block copolymers, graft and segmented copolymers, organo-polysiloxane polymer blends, and copolymer stabilized polymer blends.

Exemplary of silicone gums suitable for coating the screen are those having only methyl containing groups in the polymer chain such as polydimethylsiloxane; gums having both methyl and phenyl containing groups in the polymer chain as well as gums having both methyl and vinyl groups, methyl and fluorine groups, or methyl, phenyl and vinyl groups in the polymer chain.

Typical silicone gums which are of the thermally curable type suitable for use in the invention as elevated temperature gums are Syl Gard No. 182, Syl Off No. 22 and No. 23 manufactured by Dow Corning, Midland, Michigan; Y-3557 and Y-3602 silicone gum available from Union Carbide Company, New York, New York, as well as No. 4413 silicone and No. 4427 heat curable silicone gums available from General Electric Company, Waterford, New York. The Y-3557 and Y-3602 gums specifically have aminoalkane crosslinking sites in the polymer backbone which react with a diisocyanate crosslinking agent over a wide range of temperature and time to produce a durable, ink releasable elastomeric film.

Exemplary of suitable room temperature vulcanizable gums which can be cured at ambient temperature and atmospheric conditions include RTV-108, 106 and 118 polydimethylsiloxane gums available from General Electric Company.

The gums curable at elevated temperature are characterized by extremely high molecular weights of from about 300,000 to 700,000 while the types curable at room or low temperature have molecular weights of between about 10,000 and 100,000. Since the mechanical properties of a vulcanizate are affected by the molecular weight of the gum, that is the strength improves with increasing molecular weight, the gums curable at elevated temperature have in most cases better strength.

Ink releasable copolymers which can be employed and coalesced at elevated temperature comprise heterophase copolymeric compositions consisting of an organopolysiloxane material and a nonsilicone polymeric material. Polymeric materials which can be employed as the non-silicone component of the heterophase polymeric composition include materials such as poly($\alpha$-methylstyrene), polycarbonate, polysulfone, polystyrene, polyester, polyamide, acrylic polymers, polyurethane, and vinyl polymers. The present invention is not intended to be limited by the material for this non-silicone phase.

While not limiting, preferred proportions for the heterophase polymeric composition comprise a ratio by weight of between about 95 to 50 parts organopolysiloxane to 5 to 50 parts of the nonsilicone polymeric phase. This ratio range of organopolysiloxane to nonsilicone polymer, provides suitable ink release materials for the ink release layer of the instant printing master. Copolymers of the above type, could be typically prepared in a manner as is illustrated by the procedure for preparation of an organopolysiloxane polystyrene block-copolymer as described in Macromolecules, Volume 3, January-February 1970, pages 1–4.

The silicone can be applied to the screen by conventional means such as by spray, draw bar and dip coating, but care must be taken so that the silicone covers only the network areas to provide open pores through which the ink can pass.

Masters suitable for use in the process of the invention are conventional planographic masters. Depending upon the thickness of the screen, the viscosity of the ink and the composition of the imaged material, it may be possible to employ intaglio masters in which the image is slightly recessed but these are less preferred. The image will generally be raised and have a relief of between about 0.5 and 50 microns and preferably between 8 and 15 microns. Exemplary of suitable printing masters are those referred to as "photoresists" such as Kodak KPR, manufactured by Eastman Kodak Company. In these masters, soluble polymeric compounds are made insoluble by photo-induced crosslinking using, for example, diazo compounds or chromates. The unexposed areas are then washed out and there is thus obtained a planographic printing relief when the photosensitive film is coated on a water-wettable support.

Other suitable masters are the photoconductive coated papers such as Bruning zinc oxide coated paper manufactured by Addressograph Multigraph Corporation. These masters can be charged, imaged and developed using conventional equipment such as the Xerox Model D Processor and particulate imaging material referred to in the art as toner. Typical toners are pigmented thermoplastic polymers of styrene such as polystyrene, styrene/n-butylmethacrylate copolymer and styrenebutadiene copolymer. The image can be formed, developed and transferred to a nonphotoconductive material to produce the master or may be left on the zinc oxide coated master and treated with a suitable conversion solution such as A. B. Dick Offset electrostatic conversion solution 4–1050. Alternatively direct image masters can be employed with for example, transfer xerography. Conventional masters and imaging methods can be employed and thus the invention does not lie in the selection of these materials and methods.

Conventional inks, fountain solutions and printing equipment can be employed. In addition, other ink releasing fluids can be employed instead of the conventional aqueous fountain solutions. These fluids include polyalcohols such as glycerine, and ethylene glycol, and various hydrocarbon oils when a water based image is employed. Conventional lithographic inks are viscous but will easily pass through the screen member when the master is placed in contact therewith and a soft resilient roller, platen or similar device is pressed with ink against the screen and master. Exemplary of suitable rollers are those having a Shore A durometer of between about 35 and about 55. Sufficient pressure should be supplied such that the ink can pass to the image areas, but not so much that the nonimage areas can be contaminated with ink passing through the adhesive screen. Fountain solution may be initially applied to the nonimage areas to permit an initial application of ink to the image areas. The fountain solution may gradually be depleted, but it will not be necessary to apply fountain solution to the master after initial inking. Thus, because some ink remains on the image areas after transfer of an image to the receiver member, this ink will attract more ink through the adhesive screen during the inking step whereas there will be no such attraction for the ink free non-imaged areas.

The following examples will serve to illustrate the invention and preferred embodiments thereof. All parts and percentages in said examples and elsewhere in the specification and claims are by weight unless otherwise specified.

EXAMPLE I

A diazo-type printing master (Eastman Kodak Diazo Litho Plate D) is image wise exposed employing a pulsed Xenon lamp in a vacuum frame and the surface layer on the nonimaged and nonexposed areas removed by washing with Kodak One-Step Desensitizer-Lacquer D to provide a relief image of about 0.5 micron. Fountain solution (A. B. Dick lithographic solution) is applied to the master with a hand roller. After the background areas are thoroughly wet, a viscous lithographic ink (Van Son 10850 rubber base ink) is applied to the master using a hand rubber roller having a durometer of Shore A 35. A silicone coated screen (infra) is then placed over the master, additional ink supplied to the imaged areas by hand rolling ink onto the screen and impressions made by removing the screen and contacting the master with a paper sheet. The screen was found to be free of ink in the non-imaged areas, but not in the imaged areas. The screen is then reapplied to the master in registration, reinked the screen removed and another impression made on a paper sheet from the inked master. The inking and transfer steps are repeated several times without the need for additional fountain solution on the nonimaged areas of the master as sufficiently light pressure is applied such that only the raised image areas receive ink through the silicone screen even after the fountain solution is depleted on the master. Further, ink did not spread along the screen from the imaged areas because of the silicone coated network, and the inking roller was not contaminated with fountain solution.

The silicone screen is prepared by dipping a standard silk screen (50 microns thick with a pore size of 12 microns) in a 5 percent by volume solution of silicone copolymer (Dow Corning 90 percent polydimethylsiloxane and 10 percent alpha methyl styrene) dissolved in xylene and the screen allowed to dry in a vertical position at room temperature to evaporate the solvent and permit the silicone to be removed from the non-webbed areas of the screen.

EXAMPLE II

The general procedure of Example I is repeated but for the exception that a latent electrostatic test image is formed and cascade developed with Xerox 3600 dry toner on a photosensitive zinc oxide coated paper printing master (Brunning 2000). The toner image is vapor fused by placing the master in a Xerox vapor fuser for 7 seconds employing trichloroethylene. The imaged printing master was then etched with A. B. Dick offset electrostatic conversion solution 4–1050.

EXAMPLE III

The general procedure of Example I is repeated but for the exception that a metal screen is employed and the silicone used is prepared by dissolving 95 parts of poly(dimethylsiloxane) gum (Dow Corning Silastic 410), and 2.5 parts 2,4-dichlorobenzoyl peroxide in 900 parts heptane. After coating the master is allowed to dry at ambient temperature. The resultant member is then heated at 125° C in an air oven for 2 minutes to cure the silicone.

Having described the present invention with reference to these specific embodiments, it is to be understood that numerous variations may be made without departing from the spirit of the present invention and it is intended to encompass such reasonable variations or equivalents within its scope.

What is claimed is:

1. A method of selectively reinking a lithographic image on a master having residual ink on its image areas after transfer of an image to a receiving member comprising providing a non-imaged screen being a web with openings or pores extending through to both sides and the web being coated with an ink releasing silicone elastomer, interposing said screen between and in contact with said master and an inking member containing a viscous lithographic ink and passing ink through the pores of said screen from the inking member to the image whereby only the imaged portions of said master receive ink.

2. The method of claim 1 wherein the inking member is a roller.

3. The method of claim 1 wherein the inking member is a roller having a Shore A durometer of between about 35 and 55.

4. The method of claim 1 comprising the additional step of contacting the master with a receiver member to transfer the inked image.

5. The method of claim 1 wherein the screen has a pore size of between about 5 and about 1000 microns.

6. The method of claim 1 wherein the screen has a pore size of between about 10 and about 15 microns.

7. The method of claim 1 wherein the image has a relief of between about 0.5 and 50 microns.

8. The method of claim 1 wherein the image has a relief of between 8 and 15 microns.

9. The method of claim 1 wherein the screen has a thickness of between 12 and 100 microns.

* * * * *